US006279452B1

(12) United States Patent
Moya

(10) Patent No.: US 6,279,452 B1
(45) Date of Patent: Aug. 28, 2001

(54) AXIAL PISTON MOTOR WITH BEARING FLUSHING

(75) Inventor: Juan Moya, Horb (DE)

(73) Assignee: Brueninghaus Hydromatik GmbH, Elchingen (DE)

( * ) Notice: Subject to any disclaimer, the term of this patent is extended or adjusted under 35 U.S.C. 154(b) by 0 days.

(21) Appl. No.: 09/242,603

(22) PCT Filed: Oct. 23, 1997

(86) PCT No.: PCT/EP97/05870

§ 371 Date: Feb. 19, 1999

§ 102(e) Date: Feb. 19, 1999

(87) PCT Pub. No.: WO98/23860

PCT Pub. Date: Jun. 4, 1998

(30) Foreign Application Priority Data

Nov. 27, 1996 (DE) ..... 196 49 195

(51) Int. Cl.[7] ..... F01B 13/04
(52) U.S. Cl. ..... 91/506; 92/57
(58) Field of Search ..... 91/499, 506; 92/12.2, 92/57, 71

(56) References Cited

U.S. PATENT DOCUMENTS 4,382,399 * 5/1983 Lotter ..... 91/499
4,617,853 * 10/1986 Wagenseil et al. ..... 92/12.2
5,545,013 * 8/1996 Beck et al. ..... 417/269

FOREIGN PATENT DOCUMENTS 26 25 730 A1 12/1977 (DE) .
31 34 537 A1 3/1983 (DE) .
31 25 264 C2 7/1989 (DE) .
36 38 890 C2 8/1990 (DE) .
42 15 869 C1 9/1993 (DE) .
0 728 945 A1 8/1996 (DE) .
2 207 658 8/1973 (EP) .

* cited by examiner

*Primary Examiner*—F. Daniel Lopez
(74) *Attorney, Agent, or Firm*—Scully, Scott, Murphy & Presser

(57) ABSTRACT

The invention relates to an axial piston motor constructed as a swivel-slide structure with a channel to feed cleaning fluid to the driving shaft bearings. The axial piston motor (1) comprises a swivelling cylinder drum (8) and a driving shaft (3) supported on driving shaft bearings (4, 5). The driving shaft (3) is connected to a driving shaft flange (6) to which movable pistons (11, 12) are coupled through the cylinder bores (9, 10) of the cylinder drum (8), and on which the cylinder drum (8) is supported by a central journal (16). In addition, the invention provides for a control specular element (18) with reniform control elements and a regulating device (26), by which the cylinder drum (8) together with the control specular element (18) can be swivelled. According to the improvement added by the invention, the cleaning fluid channel is taken through the setting journal (25) and control specular element (18) up to the central journal (16). The cleaning fluid channel then continues inside the central journal (16) and the driving shaft (3) and exists at the driving shaft bearings (4, 5) that require feeding.

3 Claims, 2 Drawing Sheets

AXIAL PISTON MOTOR WITH BEARING FLUSHING

BACKGROUND OF THE INVENTION

1. Field of the Invention

The invention relates to an axial piston machine of the pivoting carriage type of construction, with an internal bearing-flushing system.

2. Discussion of the Prior Art

The starting point of the invention is an axial piston machine, such as is known, for example, from DE 42 15 869 C1. This published specification discloses an axial piston machine of the pivoting carriage type of construction. The known axial piston machine comprises a pivotable cylinder drum and a drive shaft mounted in a drive shaft bearing arrangement. The drive shaft is connected to a drive shaft flange in which pistons movable in cylinder bores in the cylinder drum are articulated and on which the cylinder drum is supported via a central journal. There is also provided, between the cylinder drum and a closing plate on the end face, a lens-shaped control mirror body which has control nodules for the cyclical connection of the cylinder bores to the working lines. A positioning arrangement, which is not represented in detail in DE 42 15 869 C1, is provided for tilting the cylinder drum, together with the control mirror body. In order to supply the drive shaft bearing arrangement with flushing agent, a flushing duct is provided in the central journal and in the drive shaft. The leakage oil draining out of the drive shaft bearing arrangement as a result of the flushing of the bearings is conveyed away in the direction of an opening in the housing by a vane wheel provided on the drive shaft flange.

From DE 36 38 890 C2, it is known practice to provide an axial piston machine of the oblique-axis type of construction having a constant, non-adjustable displacement volume, with a flushing agent duct which extends through the central journal and the drive shaft. The flushing agent is removed, by means of a valve needle which is displaceable in a pressure-dependent manner, from that control nodule of the control part which conducts low pressure.

However, this design solution cannot be used in axial piston machines of the pivoting carriage type of construction with a cylinder drum which is tiltable for the purpose of varying the displacement volume, without problems arising which cannot be overcome in practice. In particular, it has turned out that malfunctions of the valve needle occur if the control mirror body also impacts the stop means which determine the minimum and maximum displacement volumes in each case. The valve needle jams as a result of impact loads which arise in the process, and cracks can occur in the control mirror body In addition, the solution with an integrated valve needle which is known from DE 36 38 890 C2 has likewise proved unsuccessful because the bores and recesses necessary for receiving the flushing needle lead to a weakening of the control mirror body and the feeding pressure protection for the flushing agent is not constant because of the rotation and the pivoting movement of the cylinder drum and of the control mirror body. A further disadvantage is that the feeding pressure setting for the flushing agent cannot be set from outside, since the feeding pressure valve is not accessible from outside and the flushing valve integrated into the control mirror body depends upon the nominal size, since the distance between the control nodules is different for each nominal size of the axial piston machines. It has also turned out that the quantity of flushing agent introduced into the flushing duct by the flushing valve integrated into the control mirror body is inadequate for some applications.

For the reasons mentioned above, the solution known from DE 36 38 890 C2 for axial piston machines with a constant displacement volume has not proved successful in practice in the case of axial piston machines of the pivoting carriage type of construction with variable displacement volume.

SUMMARY OF THE INVENTION

The underlying object of the invention, therefore, is to make available a suitable flushing agent supply system for an axial piston machine of the pivoting carriage type of construction.

Underlying the invention is the knowledge that the flushing agent duct for supplying the drive shaft bearing arrangement with flushing agent and, optionally, for additionally flushing the housing, can be routed, in a simple manner, through the positioning journal and the control mirror body as far as the central journal. The flushing and feeding pressure valve can then be disposed out side the control mirror body, a fact which substantially simplifies the design of the latter, so that the mechanical strength of the said control mirror body is not weakened by the measures necessary for constructing the flushing duct. In addition, the advantage arises that a flushing and feeding pressure valve which can be provided externally can be set from the outside and the quantity of flushing agent introduced into the flushing agent duct can be adapted to the actual demand in a simple manner.

According to the invention, the central bore in the control mirror body for receiving the positioning journal may, at the same time, be part of the flushing agent duct, so that no design changes are necessary at the control mirror body for constructing the flushing agent duct. According to another aspect, there may be constructed in the positioning journal a bore which forms the flushing agent duct in this region and opens into the central bore in the control mirror body. Under these circumstances, the only modification to the positioning journal which is necessary for the flushing agent duct is the construction of the said bore. The bore may be constructed with a diameter which is so small that the mechanical strength of the positioning journal is insignificantly weakened by this measure, in particular by less than 1%.

According to a further aspect, the positioning arrangement may have a hydraulically actuatable positioning piston in which a transverse bore is constructed in order to receive the positioning journal. According to a still further aspect, the positioning piston may be guided in a longitudinal bore which is constructed in a closing plate and is provided with a longitudinal groove into which the bore in the positioning journal opens, either directly or else indirectly via the transverse bore in the positioning piston. Under these circumstances, the longitudinal groove guarantees a supply of flushing agent in any position of the positioning piston and of the positioning journal inserted in the latter. Under these circumstances, connection of the bore in the positioning journal to the longitudinal groove provided in the closing plate is ensured, irrespective of the pivoting position of the cylinder drum, of the control mirror body and of the positioning journal inserted in the positioning piston. According to a specific feature, the longitudinal groove may be connected to an in-feed line for the flushing agent. The flushing and feeding pressure valve for introducing the flushing agent into the flushing agent duct may be mounted externally on the closing plate at the orifice of the in-feed line. Under these circumstances, the flushing and feeding pressure valve is particularly easily settable and accessible from outside.

According to another feature, the flushing agent duct according to the invention may, as well as serving to supply the drive shaft bearing arrangement with flushing agent, at the same time also serve to flush the housing. This results in a particularly favourable heat balance for the axial piston machine, since the heat due to energy losses from the axial piston machine is conducted away, together with the flushing agent, by the agent itself.

BRIEF DESCRIPTION OF THE DRAWINGS

An exemplified embodiment of the invention will be described in greater detail below with reference to the drawings, in which.

DETAILED DESCRIPTION OF PREFERRED EMBODIMENTS

Figure 1:
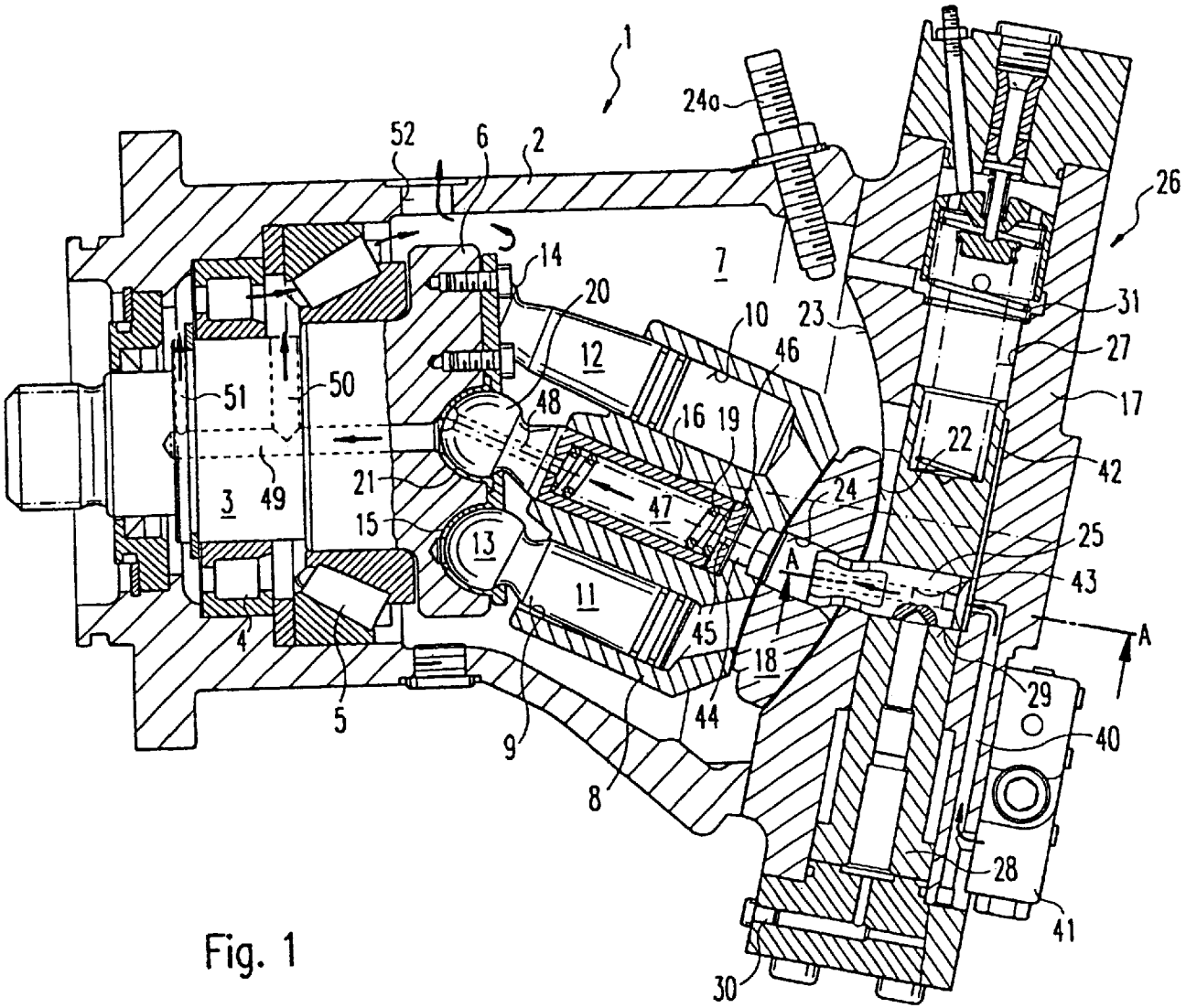
FIG. 1 shows a longitudinal section through an exemplified embodiment of the axial piston machine according to the invention.

FIG. 1 shows, in an axial longitudinal section, an exemplified embodiment of an axial piston machine according to the invention of the pivoting carriage type of construction.

A drive shaft 3 is rotatably mounted in a housing 2 of the axial piston machine 1 via two rolling bearings 4 and 5. In the exemplified embodiment, a drive shaft flange 6 is formed onto the drive shaft 3 in one piece. A cylinder drum 8 is disposed in the interior 7 of the housing so as to be pivotable about a pivoting axis perpendicular to the plane of the drawing. A number of cylinder bores 9, 10 disposed over a partial circle at equal intervals are provided in the cylinder drum 8. Displaceably guided in the cylinder bores 9, 10 are pistons 11, 12 which are shaped-out to form spherical heads 13, 14 outside the cylinder drum 8. The spherical heads 13, 14 of the pistons 11, 12 are articulated in spherical bearings 15 in the drive shaft flange 6.

The cylinder drum 8 is rotatably and tiltably mounted on the drive shaft flange 6 via a central journal 16. Disposed between a closing plate 17 and the cylinder drum 8, on that side of the said cylinder drum 8 which faces away from the drive shaft flange 6, is a control mirror body 18 which, in the exemplified embodiment, is of lens-shaped construction. The cylinder drum 8 is pre-tensioned against the control mirror body 18, or rather the closing plate 17, via a spring 19 provided in the central journal 16. The central journal 16 likewise has a spherical head 20 which is rotatably and pivotably mounted in another spherical bearing 21 in the drive shaft flange 6.

When the cylinder drum 8, which is represented in FIG. 1 in the position in which it is pivoted out to the maximum extent, is tilted, the control mirror body 18 serves as a pivoting carriage. When the cylinder drum 8 is shifted, a partially cylindrical or spherical boundary face 22 on the control mirror body 18, which boundary face is located opposite the said cylinder drum 8, slides along on a correspondingly shaped-out sliding face 23 on the closing plate 17. Under these circumstances, the set-screw 24*a* serves to set the minimum displacement volume of the axial piston machine 1.

The control mirror body 18 has a central bore 24 in which a positioning journal 25 is inserted in such a way that the said positioning journal 25 is pivotable and axially displaceable in the central bore 24 of the control mirror body 18 in order to balance out the pivoting movement of the latter.

For the purpose of hydraulically adjusting the pivoting angle of the cylinder drum 8, there is provided a positioning arrangement which is provided, in a general manner, with the reference symbol 26 and which comprises a positioning piston 28 which is displaceable in a longitudinal bore 27 in the closing plate 17. The positioning journal 25 is inserted in a transverse bore 29 in the positioning piston 28. The positioning piston 28 can be acted upon, via a positioning pressure line which can be connected to a connection 30, by a positioning pressure in such a way that the positioning piston 28 is displaceable against a restoring spring 31. Under these circumstances, the axial piston machine 1 is pivoted back towards smaller displacement volume.

According to the invention, the axial piston machine 1 is provided with a flushing agent duct for supplying flushing agent to the drive shaft bearing arrangement 4, 5. The flushing agent duct comprises an in-feed line 40 which is provided in the closing plate 17 and to which a flushing and feeding pressure valve 41 is connected. The flushing and feeding pressure valve 41 is disposed externally on the closing plate 17 and is therefore easily accessible from outside for the purpose of setting the pressure and quantity of the flushing agent. The in-feed line 40 opens into a longitudinal groove 42 which is provided peripherally on the longitudinal bore 27. In the positioning journal 25, there is also provided a bore 43 which, on the side remote from the control mirror body 18, either opens directly into the longitudinal groove 42 or else, as in the case of the exemplified embodiment represented in FIG. 1, opens indirectly into the said longitudinal groove 42 via the transverse bore 29. The length of the longitudinal groove 42 is so dimensioned that a connection between the bore 43 in the positioning journal and the said longitudinal groove 42 is ensured in any pivoting position of the cylinder drum 8.

Figure 2:
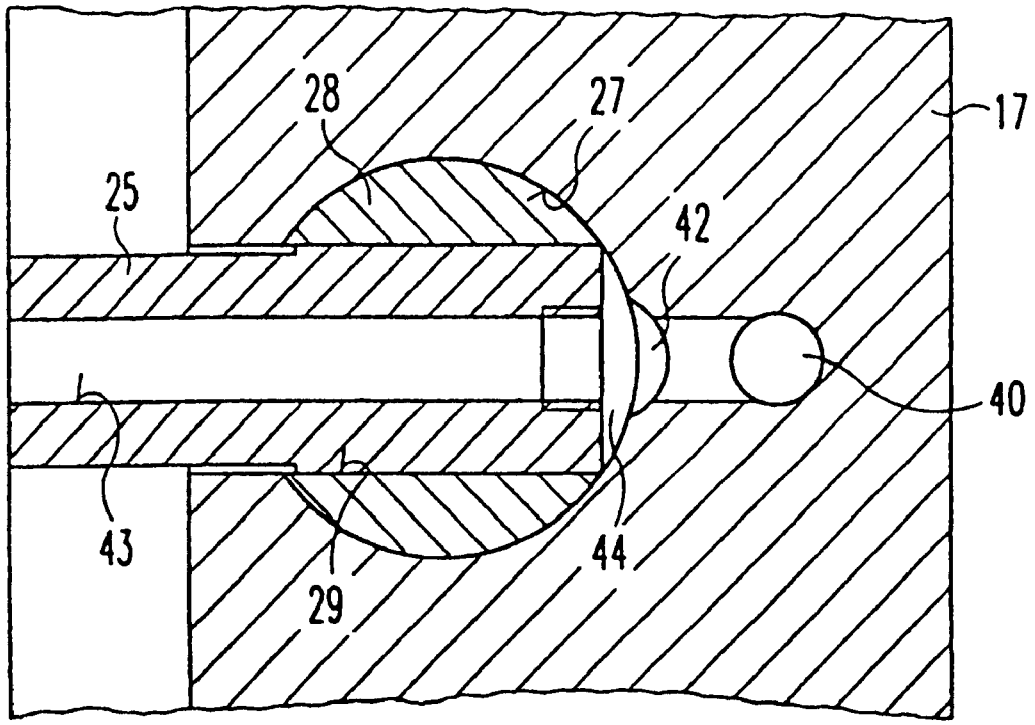
FIG. 2 shows a section along the line A—A in FIG. 1.

In order to better elucidate the way in which the flushing agent duct is routed in this region, a section along the line A—A is represented in FIG. 2. What is shown is a cross-section through the closing plate 17 and through the longitudinal bore 27 provided in the said closing plate 17 for guiding the positioning piston 28. Also visible is the positioning journal 25 which is inserted in the transverse bore 29 in the positioning piston 28 and which is represented only in the form of a detail. As already described, the positioning journal 25 has an axial bore 43 which is part of the flushing agent duct according to the invention. As can likewise be perceived from FIG. 2, the in-feed line 40 is connected to the longitudinal groove 42 provided peripherally on the longitudinal bore 27. The bore 43 in the positioning journal 25 opens indirectly into the longitudinal groove 42 via the transverse bore 29 in the positioning piston 28, which transverse bore is not filled up by the positioning journal 25 in the region 44. However, it is also possible for the bore 43 in the positioning journal 25 to open directly into the longitudinal groove 42, if the said positioning journal 25 completely fills up the transverse bore 29.

The mechanical strength of the positioning journal 25 is impaired only insignificantly by the bore 43 provided in the said journal. The diameter of the bore 43 can be of such small dimensions that the result is a reduction in mechanical strength of less than 1%. Nor is the mechanical strength of the control mirror body 18 affected by the measures according to the invention, since the solution according to the invention does not necessitate any design change in the control mirror body 18.

As can be perceived from FIG. 1, the flushing agent duct extends onwards through the central bore 24 in the control mirror body 18. In this connection, it should be emphasised that the central bore 24 in the control mirror body 18, which central bore is present in any case, also takes on the function of conducting-in the flushing agent without any further modification. The flushing agent duct extends onwards through an axial bore 44 in the cylinder drum 8 and a bore 45 in the spring plate 46, only to open into the spring compartment 47 of the central journal 16. After this, a central bore 48 extends, in the central journal 16, from the spring compartment 47 as far as the spherical bearing 21. Provided in the drive shaft 3 are further connecting ducts 49, 50 and 51 which emerge directly in the region of the rolling bearings 4, 5. At the spherical bearing 21, both the central bore 48 in the central journal 16 and also the mouth of the connecting duct 49 are provided with trumpet-shaped widened portions in order to ensure that a flux of flushing agent is made possible in any tilting position of the cylinder drum 8.

After flowing through the drive shaft bearing arrangement 4, 5, the flushing agent flows into the interior 7 of the housing, only to leave the latter as leakage fluid via the opening 52 in the housing. This simultaneously guarantees flushing of the housing which serves, inter alia, to conduct away the heat due to energy losses. In this way, the heat balance of the axial piston machine 1 is improved.

In order to better elucidate the invention, the flux of flushing agent is represented by the arrows drawn in in FIG. 1.

The invention is not limited to the exemplified embodiment represented. In particular, the influx of flushing agent to the positioning journal 25 could also take place in some other way, for example via the positioning piston 28.

What is claimed is:

1. An axial piston machine (1) of the pivoting carriage type of construction, comprising a pivotable cylinder drum (8), a drive shaft (3), a drive shaft bearing arrangement (4,5) having said drive shaft mounted therein for connection to a drive shaft flange (6), pistons (11, 12) articulated on said flange (6) being moveable in cylinder bores (9, 10) in the cylinder drum (8), a central journal (16) supporting said cylinder drum (8) on said flange (6), a flushing agent duct (45, 47 to 51) for supplying the drive shaft bearing arrangement (4, 5) with flushing agent being arranged in the central journal (16) and in the drive shaft (3), a control mirror body (18) having control nodules in order to connect the cylinder bores (9, 10) cyclically to a high-pressure line and a low-pressure line, a positioning arrangement (26) for tilting the cylinder drum (8) in conjunction with the control mirror body (18), a positioning journal (25) for connecting the positioning arrangement (26) to the control mirror body (18), said positioning arrangement (26) comprising a hydraulically actuatable positioning piston (28) which has a transverse bore (29) having the positioning journal (25) inserted therein, said flushing agent duct (43, 24) being conducted through the positioning journal (25) and the control mirror body (18) up to the central journal (16), said machine (1 having a housing (52) flushed with flushing agent through the flushing agent duct (40–43, 24, 44, 45, 47–51), an opening in said housing (52)for the simultaneous egress of the flushing agent from the housing (2) of the axial piston machine (1), a closing plate (17) includes a longitudinal bore (27), the positioning piston (28) being guided in said longitudinal bore, said closing plate (17) including at least one longitudinal groove (42) into which opens the bore (43) in the positioning journal (25) either directly or indirectly via the transverse-bore (29) in the positioning piston (28), an in-feed line (40) is arranged in the closing plate (17) for feeding the flushing agent into the longitudinal groove (42), wherein the in-feed line (40) is connected to a flushing and feeding pressure valve (41).

2. An axial piston machine according to claim 1, wherein the control mirror body (18) has a central bore (24) in which the positioning journal (25) is guided, and which central bore is a part of the flushing agent duct.

3. An axial piston machine according to claim 1, wherein a bore (43) which is part of the flushing agent duct opens into the central bore (24) in the control mirror body (18), said bore (43) being formed in the positioning journal (25).

* * * * *